United States Patent [19]

Tsuboi et al.

[11] 4,420,378

[45] Dec. 13, 1983

[54] METHOD FOR FORMING DECORATIVE COLORED STREAK PATTERNS ON THE SURFACE OF AN ALUMINUM SHAPED ARTICLE

[75] Inventors: Masatake Tsuboi, Kurobe; Hatsuo Hirono, Nyuzen; Kazuo Aikawa, Namerikawa, all of Japan

[73] Assignee: Yoshida Kogyo K. K., Tokyo, Japan

[21] Appl. No.: 304,671

[22] Filed: Sep. 22, 1981

[30] Foreign Application Priority Data

Sep. 30, 1980 [JP] Japan ..... 55-136181

[51] Int. Cl.[3] ..... C25D 11/20

[52] U.S. Cl. ..... 204/35 N; 204/42

[58] Field of Search ..... 204/35 N, 33, 42, 58

[56] References Cited

U.S. PATENT DOCUMENTS 4,221,640 9/1980 Shibata et al. ..... 204/33

FOREIGN PATENT DOCUMENTS 52-32835 3/1977 Japan ..... 204/35 N
53-65231 6/1978 Japan ..... 204/35 N
55-62196 5/1980 Japan ..... 204/35 N

OTHER PUBLICATIONS

J. M. Kape, Unusual Anodizing Processes, *Electroplating and Metal Finishing*, Nov. 1961, pp. 407–415.

*Primary Examiner*—G. L. Kaplan
*Assistant Examiner*—William Leader
*Attorney, Agent, or Firm*—Hill, Van Santen, Steadman & Simpson

[57] ABSTRACT

The invention provides a novel and improved method according to which the surface of a shaped article of aluminum or an aluminum-based alloy is provided with decorative streak patterns electrolytically engraved in the surface which can be subsequently colored to increase the decorative effect with uniform distribution over whole surface of the aluminum article. The method comprises first subjecting the anodically oxidized aluminum article to an anodic direct current electrolysis in an electrolytic solution containing a specified electrolyte and then carrying out a cathodic direct current electrolysis with the aluminum article and the counterelectrode kept as before in the same electrolytic solution as used in the first anodic direct current electrolysis with reversed polarity to give uniformly distributed streak patterns on the surface of the aluminum article. The surface of the aluminum article thus provided with the streak patterns is subsequently anodized to enhance the corrosion resistance and then subjected to a coloring treatment.

8 Claims, 2 Drawing Figures

METHOD FOR FORMING DECORATIVE COLORED STREAK PATTERNS ON THE SURFACE OF AN ALUMINUM SHAPED ARTICLE

BACKGROUND OF THE INVENTION

The present invention relates to a method for forming distinctive and decorative colored streak patterns inscribed or engraved in the surface of a shaped article of aluminum or an aluminum-based alloy (hereinafter referred to simply as aluminum) by an electrochemical means.

The inventors have previously proposed a method for forming decorative colored streak patterns on the surface of an aluminum shaped article (see Japanese Patent Kokai 56-69390). In this method, colored streak patterns are formed on the surface of an aluminum shaped article by the successive steps of carrying out electrolysis with alternating current with the aluminum shaped article having been provided with an anodized surface film as an electrode in an electrolyte solution containing at least one of the alkali metal salts and alkaline earth metal salts of organic or inorganic acids, carrying out electrolysis with direct current with the aluminum shaped article as the cathode in the same electrolyte solution as in the first electrolysis to form streak patterns engraved in the surface thereof, anodizing the surface of the aluminum shaped article thus provided with streak patterns in an electrolytic solution containing an inorganic acid and/or an organic acid to form an oxide film thereon and subjecting the oxide film to a coloring treatment.

In this prior art method, very distinctive streak patterns are obtained with clear difference in the color gradation between the streak-wise patterns and the background areas but the method is unsatisfactory in respect of the uniformity of the pattern form-up distribution of the streak patterns in unit surface area. This is because the aluminum shaped article to be finished to a final product usually has a complicated form so that the streak patterns are formed preferentially as a trend on the areas where the density of the electrolytic current is large such as the areas facing the counterelectrode with a smaller inter-electrode distance or the areas directly facing the counterelectrode.

Therefore, it has been an important problem in the aluminum industry to develop a method for forming decorative streak patterns on the surface of a shaped aluminum article with high uniformity of the pattern distribution over the whole surface of the article.

SUMMARY OF THE INVENTION

It is therefore an object of the present invention to provide a novel and improved method for forming decorative colored streak patterns on the surface of a shaped aluminum article with high uniformity of the pattern distribution.

The principle of the inventive method, established as a result of the extensive investigations undertaken by the inventors, is that a first direct current electrolysis is carried out with the aluminum article as the anode in place of the alternating current electrolysis as a part of the pattern-forming step in the method previously proposed by the inventors. It is very surprising that an unexpectedly great improvement is obtained in the uniformity of the pattern distribution despite the extreme simplicity of the principle of the inventive method.

Thus, the method of the present invention for forming decorative colored streak patterns engraved in the surface of a shaped article of aluminum comprises the successive steps of (a) carrying out a first direct current electrolysis with the aluminum article having been provided with an anodically oxidized surface film as the anode in an electrolytic solution containing at least one kind of the alkali metal ions and alkaline earth metal ions, (b) carrying out a second direct current electrolysis with the shaped article of aluminum as the cathode in an electrolytic solution of the same electrolyte composition as used in the first direct current electrolysis to form streak patterns engraved in the surface of the article, (c) anodizing the surface of the aluminum article having been provided with streak patterns in an electrolytic solution containing an inorganic acid and/or an organic acid to form an anodically oxidized surface film thereon, and (d) subjecting the anodically oxidized surface film to a coloring treatment.

DETAILED DESCRIPTION OF THE PREFERRED EMBODIMENTS

Figure 1:
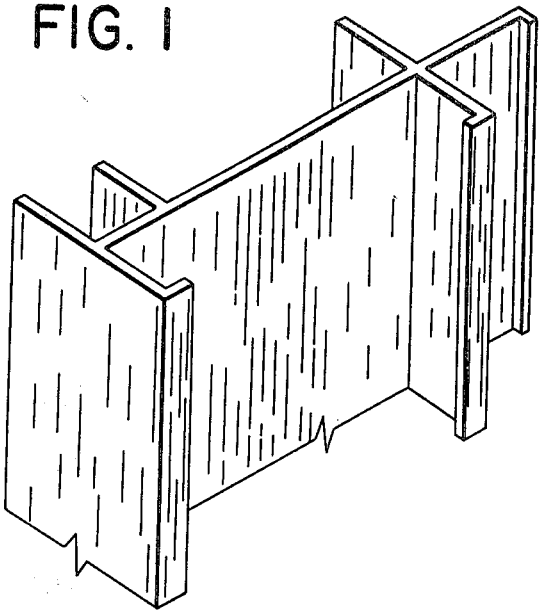
FIG. 1 is a sketch illustrating non-uniform distribution of the streak patterns formed by a conventional electrolytic method on the surface of an aluminum bar with irregular cross section.
Figure 2:
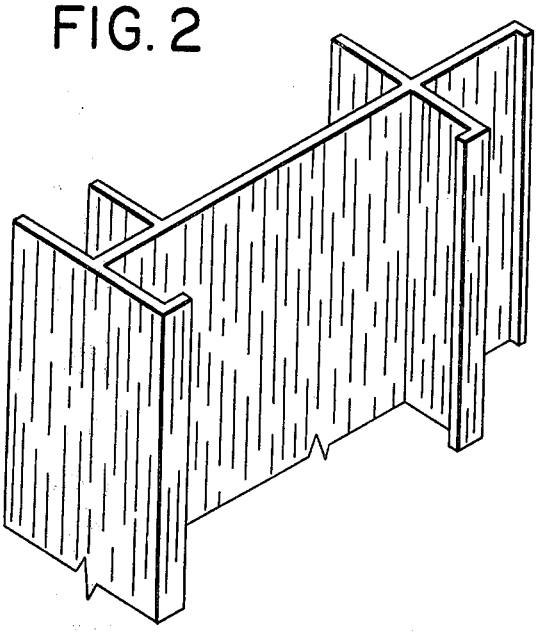
FIG. 2 is a sketch illustrating uniform distribution of the streak patterns formed by the inventive method on the same aluminum bar.

As is illustrated in FIG. 1, the distribution of the streak patterns formed on the surface of an aluminum article by the conventional method as described above is not uniform from place to place presumably due to the susceptibility of the aluminum surface to the influence of the current density on the surface. On the other hand, as is illustrated in FIG. 2, the uniformity of the distribution of the streak patterns is greatly improved when the aluminum article is treated according to the inventive method.

In the following are given various aspects of the embodiments within the scope of the method of the present invention.

In the first place, the electrolytic solution used in the first step of the anodic direct current electrolysis, i.e. the direct current electrolysis with the aluminum article as the anode, should contain at least one kind of alkali metal ions or alkaline earth metal ions in the form of a salt with an inorganic or organic acid or of a water-soluble hydroxide. Suitable salts are exemplified by potassium phosphate, potassium pyrophosphate, potassium metaphosphate, sodium metaphosphate, sodium hypophosphite, sodium pyrophosphate, sodium phosphite, trisodium phosphate, ammonium sodium hydrogenphosphate, lithium phosphate, potassium sulfate, sodium sulfate, sodium carbonate, potassium carbonate, sodium chromate, potassium chromate, sodium metaborate, sodium citrate, sodium tartrate, sodium phthalate, sodium maleate and the like as the examples of the alkali metal salts and by calcium hydrogenphosphate, calcium phosphate, magnesium phosphate, ammonium magnesium phosphate, calcium nitrate and the like as the examples of the alkaline earth metal salts. Suitable water-soluble hydroxides of alkali metal or alkaline earth metal are exemplified by sodium hydroxide, calcium hydroxide, barium hydroxide and the like. These salts and hydroxides may be used either alone or as a combination of two kinds or more according to need.

Furthermore, in order to obtain sufficiently high electric conductivity of the electrolytic solution, stabilization of the solution and appropriate pH value of the solution as mentioned below, it is preferable that the electrolytic solution is admixed with one or more kinds of inorganic and organic acids such as sulfuric acid, phosphoric acid, phosphorous acid, chromic acid, nitric acid, silicic acid, acetic acid, citric acid, gluconic acid, oxalic acid, sulfamic acid, tartaric acid and the like.

Prior to this anodic direct current electrolysis, the aluminum article is subjected to the anodization treatment in a conventional manner to provided with an anodically oxidized surface film followed by washing with water. The thus pre-treated aluminum article is dipped in the electrolytic solution containing the above mentioned electrolytes and the direct current electrolysis is carried out with the aluminum article as the anode and an electrode of stainless steel or carbon as the counterelectrode, i.e. cathode. The conditions of the electrolysis are usually selected in the ranges given below.

(1) Voltage applied to the electrodes: 5 to 50 volts or, preferably, 20 to 30 volts
(2) Concentration of the electrolyte, i.e. salt or hydroxide: 0.1 to 50 g/liter or, preferably, 1.0 to 20 g/liter
(3) pH value of the electrolytic solution: 1 to 11 or, preferably, 2 to 5
(4) Temperature of the electrolytic solution: 10° to 50° C. or, preferably, 20° to 25° C.
(5) Time of electrolysis: 0.5 to 10 minutes or, preferably, 1 to 5 minutes The next step following the above described anodic direct current electrolysis is the cathodic direct current electrolysis, i.e. the electrolysis by the application of direct current voltage with the aluminum article as the cathode. This cathodic direct current electrolysis is carried out in an electrolytic solution of the same composition as used in the preceding anodic direct current electrolysis and with the same counterelectrode of stainless steel or carbon so that it is the most convenient way to switch the polarity of the voltage applied to the electrodes after the end of the anodic direct current electrolysis with the electrodes, i.e. the aluminum article and the counterelectrode, kept in the electrolytic solution as before although it is entirely satisfactory to use another electrolytic bath of the same composition prepared separately. The wave form of the applied direct current may not be flat but any other forms can be suitably used provided that equivalent electrolytic effects are expected.

The cathodic direct current electrolysis is usually carried out at a current density of 0.5 to 3.0 A/dm$^2$ or, preferably, 1.0 to 1.5 A/dm$^2$ for a time of from 5 to 20 minutes or, preferably, from 5 to 15 minutes.

This cathodic direct current electrolysis is effective to cause adsorption of the cations of the alkali metal or alkaline earth metal on the shaped surface of the aluminum article and the sites of the adsorption serve as the starting points of the electrolytic erosion of the anodically oxidized surface film as well as the metal base of the aluminum article followed by growing of the eroded points with continuation of the electrolysis to form distinct streak patterns engraved all over the surface of the aluminum article with uniform distribution as is shown in FIG. 2.

The above mentioned electrolytic conditions should of course be selected and combined at the optimum to satisfy the desired pattern formation as the object of this cathodic direct current electrolysis in consideration of the interrelationship among the parameters of the composition, concentration, pH and temperature of the electrolyte solution as well as the applied voltage and duration of the electrolysis. For example, the voltage applied to the electrodes directly influences the density of the streak patterns per unit surface area. Further, higher density of the streak patterns with smaller distances between streaks is obtained when the time of the electrolysis is extended or the electrolysis is carried out with higher current densities. The pH value of the electrolytic solution in the range from 2 to 5 is recommended since otherwise the dissolution of aluminum over whole surface of the article is increased resulting in less satisfactory distinctness of the streak patterns.

The mechanism for such successful formation of the streak patterns with high uniformity is not well understood. It is presumable that, when the anodic direct current electrolysis is carried out, the barrier layer of the anodically oxidized surface film and the oxide film per se formed on the surface areas with remarkably larger current densities on the aluminum article such as the portions positioned at a small distance to the counterelectrode or directly facing the counterelectrode grow more than on the areas with smaller current densities such as the recessed corners of the aluminum articles resulting in the increase of the electric resistance at such areas so that, when the cathodic direct current electrolysis is undertaken successively, the electrolytic current does not concentrate in such areas due to the increased electric resistance at the portions positioned near to the electrode and, as a result, uniformity of the current density is ensured over whole surface of the aluminum article leading to the appearance of the streak patterns with high uniformity over the surface.

The surface areas of the aluminum article thus provided with the engraved streak patterns are naturally less resistant against corrosion so that it is preferable that a corrosion-resistant surface film is formed on the surface followed by the coloring treatment to impart any pleasant color tone to the surface of the aluminum article. Suitable corrosion-resistant oxide films are obtained by the anodic oxidation according to a conventional procedure. The coloring of the thus anodically oxidized surface may be carried out according to either of the following methods to give a colored surface of which the degree of coloration is usually deeper in the engraved streak patterns that on the background areas.

(1) The anodic oxidation in an electrolytic solution containing an inorganic acid and/or an organic acid is followed by dipping the aluminum article in a dye solution or a dipsersion of a pigment.

(2) The anodic oxidation in an electrolytic solution containing an inorganic acid and/or an organic acid is followed by alternating current electrolysis with the aluminum article as one of the electrodes or direct current electrolysis with the aluminum article as the cathode in an electrolyte solution containing a chromogenic inorganic metal salt to form a colored surface film.

(3) A colored surface film is obtained by the electrolytic coloring method carried out in an electrolytic solution containing an organic acid according to which the anodically oxidized surface film as formed is simultaneously colored.

In accordance with the method of the present invention, the process of pattern formation is carried out in two steps of the anodic direct current electrolysis and the cathodic direct current electrolysis as is described in the above so that the uniformity of the pattern distribution is remarkably increased over the whole surface of the aluminum article in comparison with the conventional methods. In addition, one and the same rectifier can be used as the power source in both of the electrolytic steps since both of these electrolytic steps are carried out with direct current so that a large economic advantage is obtained owing to the simplicity of the electrolytic facilities.

Following are the examples and comparative examples to illustrate the method of the present invention in further detail.

EXAMPLE 1

An aluminum article having been subjected to the pre-treatments of degreasing, etching and neutralization was dipped in an electrolytic solution containing 180 g/liter of sulfuric acid and the anodic oxidation of the surface was carried out by the electrolytic treatment for 35 minutes at a current density of 1.0 A/dm$^2$ to form a uniformly oxidized surface film.

Then, the anodic direct current electrolysis was carried out with the aluminum article as the anode and a carbon electrode as the counterelectrode in an aqueous electrolytic solution kept at 25° C. containing 3 g/liter of trisodium phosphate and 2 g/liter of phosphoric acid and having a pH of 2.5 as adjusted with sulfuric acid by applying direct current voltage of 30 volts across the electrodes for 1 minute. Thereafter, the polarity of the direct current power source was switched so that the aluminum article and the carbon counterelectrode were the cathode and the anode, respectively, and the cathodic direct current electrolysis was carried out for 10 minutes at a current density of 1.0 A/dm$^2$ with the aluminum article and the counterelectrode kept as before in the same electrolytic solution at 25° C. to form streak patterns engraved in the anodically oxidized surface of the aluminum article. The streak patterns were found to be approximately uniformly distributed over whole surface of the aluminum article as is shown in FIG. 2.

The anodic oxidation of the surface thus provided with the engraved streak patterns was carried out to form a secondary anodized oxide film in an electrolytic solution at 20° C. containing 180 g/liter of sulfuric acid by applying a constant voltage of 15 volts for 10 minutes and then electrolytic coloring treatment of the thus anodized surface was carried out in an electrolytic solution containing 30 g/liter of nickel sulfate and 30 g/liter of boric acid for 3 minutes at a voltage of 18 volts to obtain beautifully colored streak patterns with uniform distribution over whole surface of the aluminum article, the color being deeper in the engraved streak patterns that on the background areas.

EXAMPLE 2

An aluminum article having been subjected to the pre-treatment of degreasing, etching and neutralization was anodically oxidized on the surface in an electrolytic solution containing 180 g/liter of sulfuric acid for 35 minutes at a current density of 1.0 A/dm$^2$ to form an anodized oxide film on the surface.

Then, the anodic direct current electrolysis was carried out with the aluminum article as the anode and a carbon electrode as the counterelectrode in an aqueous electrolytic solution kept at 25° C. containing 10 g/liter of trisodium phosphate, 3 g/liter of potassium sulfate and 6 g/liter of phosphoric acid and having a pH of 1.8 as adjusted with sulfuric acid by applying direct current voltage of 30 volts across the electrodes for 1 minute. Thereafter, the polarity of the direct current power source was switched so that the aluminum article and the carbon counterelectrode were the cathode and the anode, respectively, and the cathodic direct current electrolysis was carried out for 10 minutes at a current density of 1.0 A/dm$^2$ with the aluminum article and the counterelectrode kept as before in the same electrolytic solution at 25° C. to form streak patterns engraved in an anodically oxidized surface of the aluminum article. The distribution of the thus formed streak patterns was approximately uniform over whole surface of the aluminum article as is shown in FIG. 2.

The anodic oxidation of the surface thus provided with the engraved streak patterns was carried out to form a secondary anodized oxide film in an electrolytic solution at 20° C. containing 180 g/liter of sulfuric acid by applying a constant voltage of 15 volts for 10 minutes and then electrolytic coloring treatment of the thus anodized surface was carried out in an electrolytic solution containing 30 g/liter of nickel sulfate and 30 g/liter of boric acid by applying an alternating current voltage to obtain beautifully colored streak patterns with uniform distribution over whole surface of the aluminum article, the color being deeper in the engraved streak patterns than on the background areas.

EXAMPLE 3

An aluminum article having been subjected to the pre-treatments of degreasing, etching and neutralization was anodically oxidized on the surface in an electrolytic solution containing 180 g/liter of sulfuric acid for 35 minutes at a current density of 1.0 A/dm$^2$ to form an oxidize film on the surface.

Then, the anodic direct current electrolysis was carried out with the aluminum article as the anode and a carbon electrode as the counterelectrode in an aqueous electrolytic solution kept at 25° C. containing 15 g/liter of trisodium phosphate, 10 g/liter of boric acid and 3 g/liter of phosphoric acid and having a pH of 4.5 as adjusted with oxalic acid by applying a direct current voltage of 30 volts across the electrodes for 1 minute. Thereafter, the polarity of the direct current power source was switched so that the aluminum article and the carbon counterelectrode were the cathode and the anode, respectively, and the cathodic direct current electrolysis was carried out for 15 minutes at a current density of 1.0 A/dm$^2$ with the aluminum article and the counterelectrode kept as before in the same electrolytic solution at 25° C. to form streak patterns engraved in the anodically oxidized surface of the aluminum article. The distribution of the thus formed streak patterns was approximately uniform over whole surface of the aluminum article as is shown in FIG. 2.

The anodic oxidation of the surface thus provided with the engraved streak patterns was carried out to form a secondary anodized oxide film in an electrolytic solution kept at 20° C. containing 180 g/liter of sulfuric acid by applying a constant voltage of 15 volts for 10 minutes and then electrolytic coloring treatment of the thus anodized surface was carried out in an electrolytic solution containing 30 g/liter of nickel sulfate and 30 g/liter of boric acid for 3 minutes by applying an alternating current voltage of 20 volts to obtain beautifully colored streak patterns with uniform distribution over whole surface of the aluminum article, the color being deeper in the engraved streak patterns than on the background areas.

EXAMPLE 4

An aluminum article having been subjected to the pre-treatments of degreasing, etching and neutralization was anodically oxidized on the surface in an electrolytic solution containing 180 g/liter of sulfuric acid for 40 minutes at a current density of 1.0 A/dm$^2$ to form an anodized oxide film on the surface.

Then, the anodic current electrolysis was carried out with the aluminum article as the anode and a carbon electrode as the counterelectrode in an aqueous electrolytic solution kept at 20° C. containing 6 g/liter of potassium sulfate and 2 g/liter of phosphoric acid and having a pH of 2.0 as adjusted with sulfuric acid by applying a direct current voltage of 40 volts across the electrodes for 1 minute. Thereafter, the polarity of the direct current power source was switched so that the aluminum article and the carbon counterelectrode were the cathode and the anode, respectively, and the cathodic direct current electrolysis was carried out for 10 minutes at a current density of 1.0 A/dm$^2$ with the aluminum article and the counterelectrode kept as before in the same electrolytic solution at 20° C. to form streak patterns engraved in the anodically oxidized surface of the aluminum article. The distribution of the thus formed streak patterns was approximately uniform over whole surface of the aluminum article as is shown in FIG. 2.

The anodic oxidation of the surface thus provided with the engraved streak patterns was carried out to form a secondary anodized oxide film in an electrolytic solution at 20° C. containing 180 g/liter of sulfuric acid by applying a constant voltage of 15 volts for 10 minutes and the electrolytic coloring treatment of the thus anodized surface was carried out in an electrolytic solution containing 30 g/liter of nickel sulfate and 30 g/liter of boric acid by applying an alternating current voltage to obtain beautifully colored streak patterns with uniform distribution over whole surface of the aluminum article, the color being deeper in the engraved streak patterns than on the background areas.

EXAMPLE 5

An aluminum article having been subjected to the pre-treatments of degreasing, etching and neutralization was anodically oxidized on the surface in an electrolytic solution containing 180 g/liter of sulfuric acid for 40 minutes at a current density of 1.0 A/dm$^2$ to form an anodized oxide film on the surface.

Then, the anodic direct current electrolysis was carried out with the aluminum article as the anode and a carbon electrode as the counterelectrode in an aqueous electrolytic solution kept at 25° C. containing 3 g/liter of calcium nitrate and 2 g/liter of phosphoric acid and having a pH of 2.0 as adjusted with sulfuric acid by applying a direct current voltage of 30 volts across the electrodes for 1 minute. Thereafter, the polarity of the direct current power source was switched so that the aluminum article and the carbon counterelectrode were the cathode and the anode, respectively, and the cathodic direct current electrolysis was carried out for 15 minutes at a current density of 1.0 A/dm$^2$ with the aluminum article and the counterelectrode kept as before in the same electrolytic solution at 25° C. to form streak patterns engraved in the anodically oxidized surface of the aluminum article. The distribution of the thus formed streak patterns was approximately uniform over whole surface of the aluminum article as is shown in FIG. 2.

The anodic oxidation of the surface thus provided with the engraved streak patterns was carried out to form a secondary anodized oxide film in an electrolytic solution kept at 20° C. containing 180 g/liter of sulfuric acid by applying a constant voltage of 15 volts for 10 minutes and then electrolytic coloring treatment of the thus anodized surface was carried out in an electrolytic solution containing 30 g/liter of nickel sulfate and 30 g/liter of boric acid for 3 minutes by applying an alternating current voltage of 19 volts to obtain beautifully colored streak patterns with uniform distribution over whole surface of the aluminum article, the color being deeper in the engraved streak patterns than on the background areas.

EXAMPLE 6

An aluminum article having been subjected to the pre-treatments of degreasing, etching and neutralization was anodically oxidized on the surface in an electrolytic solution containing 180 g/liter of sulfuric acid for 40 minutes at a current density of 1.0 A/dm$^2$ to form an anodized oxide film on the surface.

Then, the anodic direct current electrolysis was carried out with the aluminum article as the anode and a carbon electrode as the counterelectrode in an aqueous electrolytic solution kept at 20° C. containing 10 g/liter of sodium sulfate and 2 g/liter of phosphoric acid and having a pH of 2.0 as adjusted with sulfuric acid by applying a direct current voltage of 50 volts across the electrodes for 1 minute. Thereafter, the polarity of the direct current power source was switched so that the aluminum article and the carbon counterelectrode were the cathode and the anode, respectively, and the cathodic direct current electrolysis was carried out for 15 minutes at a current density of 1.0 A/dm$^2$ with the aluminum article and the counterelectrode kept as before in the same electrolytic solution at 20° C. to form streak patterns engraved in the anodically oxidized surface of the aluminum article. The distribution of the thus formed streak patterns was approximately uniform over whole surface of the aluminum article as is shown in FIG. 2.

The anodic oxidation of the surface thus provided with the engraved streak patterns was carried out to form a secondary anodized oxide film in an electrolytic solution kept at 20° C. containing 180 g/liter of sulfuric acid by applying a constant voltage of 15 volts for 10 minutes and then electrolytic coloring treatment of the thus anodized surface was carried out in an electrolytic solution containing 30 g/liter of nickel sulfate and 30 g/liter of boric acid for 6 minutes by applying a voltage of 16 volts to obtain beautifully colored streak patterns with uniform distribution over whole surface of the aluminum article, the color being deeper in the engraved streak patterns than on the background areas.

EXAMPLE 7

An aluminum article having been subjected to the pre-treatments of degreasing, etching and neutralization was anodically oxidized on the surface in an electrolytic solution containing 180 g/liter of sulfuric acid for 40 minutes at a current density of 1.0 A/dm$^2$ to form an anodized oxide film on the surface.

Then, the anodic direct current electrolysis was carried out with the aluminum article as the anode and a carbon electrode as the counterelectrode in an aqueous electrolytic solution kept at 25° C. containing 3 g/liter of barium hydroxide and 2 g/liter of phosphoric acid and having a pH of 1.8 as adjusted with sulfuric acid by applying a direct current voltage of 25 volts across the electrodes for 1 minute. Thereafter, the polarity of the direct current power source was switched so that the aluminum article and the carbon counterelectrode were the cathode and the anode, respectively, and the cathodic direct current electrolysis was carried out for 20 minutes at a current density of 1.0 A/dm$^2$ with the aluminum article and the counterelectrode kept as before in the same electrolytic solution at 25° C. to form streak patterns engraved in the anodically oxidized surface of the aluminum article. The distribution of the thus formed streak patterns was approximately uniform over whole surface of the aluminum article as is shown in FIG. 2.

The anodic oxidation of the surface thus provided with the engraved streak patterns was carried out to form a secondary anodized oxide film in an electrolytic solution kept at 20° C. containing 180 g/liter of sulfuric acid by applying a constant voltage of 15 volts for 10 minutes and then electrolytic coloring treatment of the thus anodized surface was carried out in an electrolytic solution containing 30 g/liter of nickel sulfate and 30 g/liter of boric acid for 3 minutes by applying a voltage of 18 volts to obtain beautifully colored streak patterns with uniform distribution over whole surface of the aluminum article, the color being deeper in the engraved streak patterns than on the background areas.

COMPARATIVE EXAMPLE 1

An aluminum article was subjected to the pre-treatments in the same manner as in Example 1 and then provided with an anodized oxide film on the surface. Cathodic direct current electrolysis was undertaken with this anodized aluminum article as the cathode and a carbon electrode as the counterelectrode in an aqueous electrolytic solution kept at 25° C. containing 3 g/liter of trisodium phosphate and 2 g/liter of phosphoric acid and having a pH of 1.8 as adjusted with sulfuric acid by applying a direct current voltage for 10 minutes at a current density of 1.0 A/dm$^2$ to form streak patterns on the surface. In this case, however, the distribution of the streak patterns was not uniform as is shown in FIG. 1, the density of the streaks being larger on the areas closely positioned to the counterelectrode and smaller on the areas remote from the counterelectrode where the electrolytic current density was smaller.

COMPARATIVE EXAMPLE 2

An aluminum article was subjected to the pre-treatments in the same manner as in Example 1 and then provided with an anodized oxide film on the surface. Alternating current electrolysis was undertaken with this anodized aluminum article as one of the electrodes and a carbon electrode as the counterelectrode in an aqueous electrolytic solution kept at 25° C. containing 3 g/liter of trisodium phosphate and 2 g/liter of phosphoric acid and having a pH of 1.8 as adjusted with sulfuric acid by applying an alternating current voltage of 30 volts for 1 minute. Thereafter, cathodic direct current electrolysis was undertaken by connecting the electrodes to a direct current power source, the aluminum article and the carbon counterelectrode being the cathode and the anode, respectively, by applying a direct current voltage across the electrodes kept as before in the same electrolytic solution at 25° C. for 20 minutes at a current density of 1.0 A/dm$^2$ to form engraved streak patterns. In this case, however, the distribution of the streak patterns was not uniform as is shown in FIG. 1, the streak patterns concentrating on the areas positioned closely to and directly facing the counterelectrode resulting in only localized formation of the streak patterns on the areas where the electrolytic current density was smaller.

What is claimed is:

1. A method for forming decorative colored streak patterns on the surface of a shaped article of aluminum or an aluminum-based alloy by erosion which comprises the successive steps of (a) carrying out an anodic direct current electrolysis with the aluminum article having been previously provided with an anodically oxidized surface film as the anode in an electrolytic solution containing at least one kind of alkali metal ions or alkaline earth metal ions for a period of from 0.5 to 10 minutes, (b) thereafter carrying out a cathodic direct current electrolysis with the aluminum article as the cathode in an electrolytic solution of substantially the same composition as used in the anodic direct current electrolysis of the step (a) for period of from 5 to 20 minutes to form eroded streak patterns engraved in the surface of the aluminum article, (c) anodizing the surface of the aluminum article having been provided with the streak patterns in an electrolytic solution containing at least one inorganic or organic acid to form an anodically oxidized surface film thereon, and (d) subjecting the aluminum article provided with the anodically oxidized surface film to a coloring treatment.

2. The method as claimed in claim 1 wherein the alkali metal ions or alkaline earth metal ions in the electrolytic solution used in the step (a) are provided by dissolving at least one of the salts or hydroxides selected from the group consisting of potassium phosphate, potassium pyrophosphate, potassium metaphosphate, sodium metaphosphate, sodium hypophosphite, sodium pyrophosphate, sodium phosphite, trisodium phosphate, sodium ammonium hydrogenphosphate, lithium phosphate, potassium sulfate, sodium sulfate, sodium carbonate, potassium carbonate, sodium chromate, potassium chromate, sodium metaborate, sodium citrate, sodium tartrate, sodium phthalate, sodium maleate, calcium hydrogenphosphate, calcium phosphate, magnesium phosphate, magnesium ammonium phosphate, calcium nitrate, sodium hydroxide, calcium hydroxide and barium hydroxide in the electrolytic solution.

3. The method as claimed in claim 2 wherein the concentration of the salt or hydroxide in the electrolytic solution is in the range from 0.1 to 50 g/liter.

4. The method as claimed in claim 1 wherein the pH value of the electrolytic solution used in the step (a) is in the range from 1 to 11.

5. The method as claimed in claim 4 wherein the electrolytic solution has the value of pH as adjusted by the addition of an acid selected from the group consisting of sulfuric acid, phosphoric acid, phosphorous acid, chromic acid, nitric acid, silicic acid, acetic acid, citric acid, gluconic acid, oxalic acid, sulfamic acid and tartaric acid.

6. The method as claimed in claim 1 wherein the electrolytic solution used in the step (a) is at a temperature in the range from 10° to 50° C.

7. The method as claimed in claim 1 wherein the anodic direct current electrolysis in the step (a) is carried out by applying a direct current voltage in the range from 5 to 50 volts.

8. The method as claimed in claim 1 wherein the cathodic direct current electrolysis in the step (b) is carried out at a current density in the range from 0.5 to 3.0 $A/dm^2$.

* * * * *